United States Patent [19]

Newman et al.

[11] 3,942,985

[45] Mar. 9, 1976

[54] HIGH CONTRAST, RAPID ACCESS, AIR STABLE, REGENERABLE IRON CHELATE DEVELOPER SOLUTIONS

[75] Inventors: Norman Newman; Richard S. Fisch, both of St. Paul, Minn.

[73] Assignee: Minnesota Mining and Manufacturing Company, St. Paul, Minn.

[22] Filed: Mar. 28, 1975

[21] Appl. No.: 563,086

Related U.S. Application Data

[63] Continuation-in-part of Ser. No. 391,506, Aug. 24, 1973, abandoned.

[52] U.S. Cl. ..... 96/66.3; 96/48 R; 96/50 R; 96/66 R

[51] Int. Cl.[2] ..... G03C 5/30; G03C 5/26

[58] Field of Search ..... 96/66.3, 66 R, 48 R, 50 R

[56] References Cited

UNITED STATES PATENTS

| | | | |
|---|---|---|---|
| 2,688,548 | 9/1954 | Reynolds | 96/66 HD |
| 2,688,549 | 9/1954 | Reynolds | 96/66 HD |
| 3,567,441 | 3/1971 | Vogt | 96/66 R |
| 3,723,126 | 3/1973 | Price | 96/48 R |

*Primary Examiner*—Mary F. Kelley

*Attorney, Agent, or Firm*—Alexander, Sell, Steldt & DeLaHunt

[57] ABSTRACT

High contrast, rapid access, air stable, regenerable iron chelate developer solutions comprising at least two developer materials, at least one selected from each group comprising:

1. iron chelate developers and
2. an ascorbic acid developer.

4 Claims, No Drawings

HIGH CONTRAST, RAPID ACCESS, AIR STABLE, REGENERABLE IRON CHELATE DEVELOPER SOLUTIONS

CROSS-REFERENCE TO RELATED APPLICATIONS

This application is a continuation-in-part of Ser. No. 391,506 filed Aug. 24, 1973, now abandoned This invention relates to photographic science and in particular to silver halide photographic emulsion development.

Exposure of a silver halide emulsion to radiation to which the emulsion has been sensitized produces a latent image in the silver halide grains of the emulsion. The image is latent because the grains are sensitized to reduction by the formation of minute quantities of free silver in the grains from the exposure. The grains are developed usually by immersion of the exposed photosensitive material in an aqueous reducing solution. The reducing agents conventionally employed include such organic materials as hydroquinone and other materials meeting the criteria of Kendall's Rule or the extension of this rule by Peltz [Mason, *Photographic Chemistry*, pp. 16–29, Focal Press, 1966, London].

Historically, the organic reducing agents presently in commercial use were preceded by the use of inorganic metal salt solutions as developers. Ferrous sulfate solutions were among the first used, these being followed by complexed ferrous ion solutions such as ferrous oxalate. Although the complexed ion solutions offered tremendous developing advantages over the simple salt solutions, they nonetheless still suffered from exhaustion because of the antagonistic effect of the presence of the oxidized form of the metal ion (e.g., ferric). Because the reduction of the silver with the consequent oxidation of the metal ion is an equilibrium reaction, the presence of ferric ions greatly reduces the thermodynamic driving force for the reaction. The improvement offered by the complexing species was in the suppression of the oxidized form of the metal ion by formation of the complex. The failure of these complexed type developers, even with the introduction of the superior complexing agents, due to oxidized ion, is generally unavoidable since these oxidized ions may be formed by development or aerial oxidation. In fact, in order to obtain consistent results with such developers, development has been performed under a nitrogen atmosphere so as to exclude oxygen (U.S. Pat. No. 2,453,323). Other techniques have been attempted to obtain consistent results in these metal salt solutions, such as the inclusion of metal powders or granules in the development solution itself, trying to maintain the dissolved metal ions in their lower valence state. Amman-Brass, Beitrag Zur Chemie dir Anorganischen Entwickler, Photo. Ind. 1937, p. 827. These developers have not found favor in the photographic field because the developing solutions are, at their best, still slow acting, requiring at least about 20 minutes for completion of development and sometimes hours. The solutions also tend to produce low contrast images and do not correct for other changes in the composition of the bath due to the development process.

Recent work has been directed towards obtaining more active rapid acting developers. S. Mizusawa - Chiba Daiga Ku Kobabubu Kentyu Hokoko (Research Reports Chiba U. Facility of Engineering), Vol. 19 No. 35 pp. 77–84, Mar. 61 discloses a monobath developer based on the use of ferrous EDTA (ethylenediaminetetraacetic acid) and hypo (Na or $NH_4$ thiosulfate). Although Mizusawa shows the superadditivity of development by the addition of phenidone to this system he nevertheless requires a pH of 11.0 with a development time of 8 minutes or more at 20°C. to obtain average contrasts in the order or 1.0.

Vogt, U.S. Pat. No. 3,567,441 discloses that these developers are suitable for rapid access development at temperatures ranging from 65°F. to 212°F. in a pH range of 4 – 6.9 with development times in the order of 3 minutes. In order to obtain these short processing times of 3 minutes or less, this patent states that a hardening agent for the gelatin must be included in this developer. The inclusion of aldehyes in metal complex developers has previously been reported in British Pat. No. 741, 1889.

It is believed that the Vogt process must operate under a non-oxidizing atmosphere (e.g., nitrogen) in order to operate consistently. In view of this requirement the practical application of these developers has been reported (G. Haist et al., Photo. Engineering, Vol. 7, 182–189, 1956) as still limited.

The practice of this invention generally relates to air stable, rapid access, regenerable metal chelate developer solutions. The terminology air stable, rapid access and regenerable described substantive properties of the developer solutions.

The developer solutions of this invention comprise an aqueous solution of a metal chelate developer and a second component of ascorbic acid, sugar-type derivatives of ascorbic acid, and stereoisomers and diastereoisomers of ascorbic acid and its sugar-type derivatives. The unsubstituted compounds of this class may be represented by the formula:

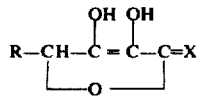

wherein X is an oxygen atom or imino group, R is any group which does not render the ascorbic acids water insoluble and is a non-interfering group. Non-interference means that the R group does not cause stearic hindrance, is not chemically reactive with other portions of the molecule, is not a coordinating group for the molecule and is not more electropositive than a saturated hydrocarbon residue. Preferably R is an aryl group or a group of the formula $$R^1CH_2(CHOH)_{n-1}-$$

wherein $n$ is a positive integer from 1 to 4 and $R^1$ is either a hydrogen atom or hydroxyl group when $n$ is 2 to 4 and is an hydroxyl group when $n$ is 1. Of these materials, ascorbic and isoascorbic acid are the most preferred. The second developer component must be soluble at least to 0.05 Molar and should be in the binary developer solution in an amount from 0.05 M to the solubility limit of the second developer.

The term metal chelate developing agent as used in the practice of this invention refers to iron associated with a chelating agent, sequestering agent or complexing agent (for the practice of this invention, these are alternative terms). The metal portion of the metal chelate is required to have at least two distinct valence states (i.e., $Fe^{+2}$ and $Fe^{+3}$ for iron).

The lower valent ion is the developing agent (reducing agent) which usually functions by simple electron transfer to the silver ion; the higher valent metal ion is formed as a result. The presence of these latter oxidized ions (higher valent ions) provides an antagonistic effect toward the further reduction of silver halide by the lower valent ion, and small buildup of such higher valent ions by either the result of development or aerial oxidation is sufficient to seriously hamper the development reaction.

The chelate portion of the metal chelate are those chelate, sequestering or complexing materials whose stability constant for the higher valence state of a metal is higher than that for the lower valence state. These stability constants may be found for example in reference books (e.g., *Stability Constants of Metal-Ion Complexes*, Chemical Society, London, 1964). In the most preferred embodiments, the ratio of the stability constants of the higher state to the lower state should be at least 100:1 respectively. The most preferred chelating agents in the practice of this invention are ethylenediaminetetraacetic acid and diethylenetriaminepentaacetic acid (EDTA and DTPA respectively).

For a particular metal ion developer, satisfactory complexing agents are those which form a more stable complex with the higher valent ion that the lower valent ion (Mason, *Photographic Chemistry*, Focal Press, 1966, p. 173) thus effectively reducing the concentration of the antagonist higher valent ion. The fact is, nevertheless, that the buildup of the higher valent ion, either by the development reaction or aerial oxidation, proceeds and even in the presence of these complexing agents, the baths eventually deteriorate and become unuseable (C. E. Mees, 2nd Ed., McMillan, 1942, p. 332). The addition of various additives such as formaldehyde (Brit. Pat. No. 741; 1889), though successful in hardening the emulsion, provide no improvement in aerial stability.

Rzymkowski in 1941 (Rzymkowski, Wiss. Photo. 40 136 (1941)) categorized the metal complex developers as having the following structure:

$$(Alk^{+1})_x\,[(RCOO^-)_y M_m^{+z}]$$

in which Alk is an alkali metal, M is the metal ion of a multiple valent metal and R is an organic radical and $y = mz + n$. These materials are included within the present disclosure of metal chelates.

The earliest successful use of iron, i.e., ferrous ion, in a developer was by Carey Lea (B. J. Phot. 24, 292 (1877)). Lea utilized a "complexing agent", potassium oxalate, in his developer.

In 1951 Rausch and Russel introduced developers using a different class of complexing agents which showed much greater superiority in their affinity to complex the higher valent metal species and so exhibited some improved performance of the developers. These materials were aliphatic amino-polycarboxylic acids and their water soluble salts (Br. Pat. No. 720,235) commonly known at the times as "chelating" or "sequestering" agents which have given rise to the term "metal chelate developers". Rzymkowski in 1951 (Pharmazie (1951) 6, p. 155–6) noted that these developers fitted his definition and equated the terminology of metal complex and metal chelate developers (Industrie Chim. Belg. Spec. No. 645–6 (1955)). This terminology based on this narrowed definition for the word complex persists to the present, and in fact there are few metal complex developers which are based on a complexing agent rather than a chelating agent of one sort or another.

The practice of this invention generally relates to air stable, rapid access and regenerable described substantive properties of the developer solutions.

Air stable metal chelate developer solutions are those which do not undergo a change of greater than 50 millivolts in its redox potential during two days exposure In the use of these metal chelate developers, such air stability enables the maintenance of a desired level of developmental activity without requiring the groups addition of replacement chemistry.

The solutions of this developing system are rapid access developers. This means that the dwell time in the developer need be only 4 minutes or less for producing a useful image having 90% of the useful Dmax produced by that developer in 8 minutes with the same exposure and handling of the photographic element. The useful Dmax may, of course, depend upon the particular application of the photographic element, but must be viewable over fog levels of the elements. It is preferred that the dwell time need be only 2 minutes for 90% of the useful Dmax of 4 minutes dwell time in the same developer.

The solutions are also regenerable. This means that the solution, after or during use may be maintained at the same level of electromotive potential without the gross addition of replacement chemistry. The solutions of this invention may be maintained at the proper level of chemical activity by the reduction of the spent (oxidized) metal ions to their development (reduced) state without the addition of supplemental chemistry, i.e., by only the contacting of the spent metal ion with a metal which will reduce the ion. In addition, the term regenerable means that if the system is allowed to stand in air when not operating, the operating electrochemical potential of the solution can be reached within one hour by contacting the solution with sufficient surface area of metal capable of reducing oxidized metal developer ions.

The developer solutions according to the practice of this invention may additionally contain those additives commonly associated with developer solutions. These additives include for example, hardeners (e.g., aldehydes, aluminum salts, etc.), swell control agents (e.g., sulfate), anti-foggants, development accelerators, surfactants, viscosity control agents and various pH buffering agents. The developer solutions of this invention are also easily concentrated. Concentrates of these solutions are also air stable and may be readily diluted with water to form developer solutions. Silver complexing materials (containing or not containing silver) may also be added to these developing solutions to obtain physical and/or solvent development characteristics.

The developer solutions of the present invention may be used with any black and white silver halide photographic element, and in any black and white development step for any color silver halide photographic elements.

EXAMPLE I

Samples of a controlled sensitometrically exposed, commercial high contrast (microfilm type) chloro-bromide silver halide element were developed in a series of developer solutions for 30 seconds at 90°F, washed, fixed*, washed and dried. After this processing, the resulting densities of these processed films were measured with a MACBETH densitometer at identical exposure values. The series of developer solutions are indicated below.

| Solution** No. | Ingredient | Amount | Density | Contrast |
|---|---|---|---|---|
| 1 | $FeSO_4$ | 0.15M | 0.90 | 1.40 |
| 2 | Ascorbic Acid | 0.26M | 0.02 | —*** |
| 3 | $FeSO_4$ / Ascorbic Acid | 0.15M / 0.26M | 1.10 | 1.73 |

*The fixing solution in all examples was the F-5 Fixer of Eastman Kodak, the formula as referenced in Photo Lab. Index, Morgan and Morgan, Inc., Hastings on Hudson, N.Y. 1966, pp. 6–91.

**All solutions adjusted to pH 8.25 with $Na_4OH$ and contained 0.08M KBr.

***not measurable.

The unexpectedly high contrast of this solution is apparent from the above data. An increased contrast and image density are resultant from the use of the recited class of ascorbic acid type materials with metal chelate developers. Another result is air stability of the solutions combining the metal chelate and ascorbic acid type second developer component.

EXAMPLE II

To examine the air stability of the binary developer solutions of this invention, the following solution was made:

0.1 Molar $FeSO_4$
0.2 Molar Diethylenetriamine pentaacetic acid
0.03 Molar KBr
pH adjusted to 6.0 with NaOH A second solution was made from this first solution by the addition of 5 grams per liter of ascorbic acid. Both resulting solutions were stored and monitored at various times for their redox potential using the apparatus indicated above (platinum electrode, saturated calomel, and pH/millivolt indicating device). The redox potential, as indicated in copending U.S. Ser. No. 391,508, is a direct indication of the photographic effect (resultant density) of the developer solution; the more negative the potential, the higher is the density.

The measured results appear below:

| | Potential Change (mv) | | | Density Change |
|---|---|---|---|---|
| | Δ1 day | Δ2 day | Δ4 day | Δ4 day |
| Fe - DTPA | +90 | +180 | +260 | −1.10 |
| Fe - DTPA + Ascorbic Acid | 0 | + 10 | + 30 | −0.18 |

The data indicates the superior air stability of the developing solution containing the ascorbic acid type developers.

What we claim is:

1. An aqueous, high-contrast, air-stable, rapid access, non-fixing developer solution which comprises a. at least one iron chelate developer and
b. at least one compound from the group of ascorbic acid, sugar-type derivatives of ascorbic acid and stereoisomers and diastereoisomers of ascorbic acid and its sugar-type derivatives.

2. The developer solution of claim 1 wherein the at least one compound is selected from ascorbic acid and isoascorbic acid.

3. The developer solution of claim 1 wherein the iron chelate developer is selected from ferrous ethylenediaminetetraacetic acid and ferrous diethylenetriaminepentaacetic acid.

4. The developer of claim 2 wherein the iron chelate developer is selected from ferrous ethylenediaminetetraacetic acid and ferrous diethylenetriaminepentaacetic acid.

* * * * *